US005575343A

United States Patent [19]

Gray

[11] Patent Number: 5,575,343

[45] Date of Patent: Nov. 19, 1996

[54] DRILLING A BORE HOLE HAVING A SHORT RADIUS CURVED SECTION FOLLOWED BY A STRAIGHT SECTION

[75] Inventor: Benjamin Gray, Silver Valley, Canada

[73] Assignee: Sidekick Tools Inc., Alberta, Canada

[21] Appl. No.: 507,187

[22] Filed: Jul. 26, 1995

Related U.S. Application Data

[63] Continuation of Ser. No. 352,039, Nov. 30, 1994, abandoned, which is a continuation-in-part of Ser. No. 179,560, Jan. 20, 1994, abandoned.

[51] Int. Cl.[6] ..... E21B 7/04; E21B 7/08

[52] U.S. Cl. ..... 175/61; 175/74; 175/107

[58] Field of Search ..... 175/61, 62, 45, 175/74, 107, 322

[56] References Cited

U.S. PATENT DOCUMENTS

| | | |
|---|---|---|
| 3,903,974 | 9/1975 | Cullen . |
| 4,220,213 | 9/1980 | Hamilton . |
| 4,333,539 | 6/1982 | Lyons et al. . |
| 4,442,908 | 4/1984 | Steenbock . |
| 4,465,147 | 8/1984 | Feenstra . |
| 4,492,276 | 1/1985 | Kamp . |
| 4,515,220 | 5/1985 | Sizer et al. . |
| 4,679,637 | 7/1987 | Cherrington et al. . |
| 4,699,224 | 10/1987 | Burton . |
| 4,739,843 | 4/1988 | Burton . |
| 5,090,496 | 2/1992 | Walker . |
| 5,113,953 | 5/1992 | Noble . |
| 5,265,687 | 11/1993 | Gray . |
| 5,311,952 | 5/1994 | Eddison et al. . |

*Primary Examiner*—Frank Tsay
*Attorney, Agent, or Firm*—Adrian D. Battison; Murray E. Thrift

[57] ABSTRACT

A method is provided for drilling of a well bore portion including a short radius curved section followed by a straight section. A drilling tool is provided having a first portion on which the drill bit is mounted and a second portion carrying the motor with a knuckle coupling therebetween. The short radius curved section is completed using the drilling tool with the knuckle coupling diverting to one side of the bore to steer the drill bit to the other side. After the curved section is complete the drilling is controlled in an accurately straight orientation by providing an eccentric collar which is attached onto the drilling tool at a position adjacent the knuckle portion. The eccentric collar holds the drilling tool at a slight angle less than that during the curved section. Simultaneously with the rotation of the drill bit, the drill string, the tool and the collar are rotated more slowly about the longitudinal axis so as to constantly vary the angle of attack of the drill bit. In one arrangement, prior to attachment of the eccentric collar, a cylindrical or concentric collar is attached for drilling of a first short section of the horizontal portion. In an alternative arrangement, the eccentric collar has two flat sides which allow the collar and tool to rotate in a slightly curved bore without binding.

26 Claims, 5 Drawing Sheets

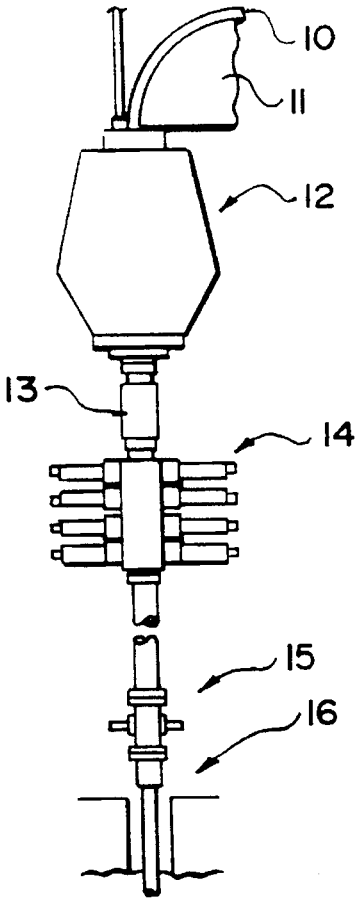
FIG. 1
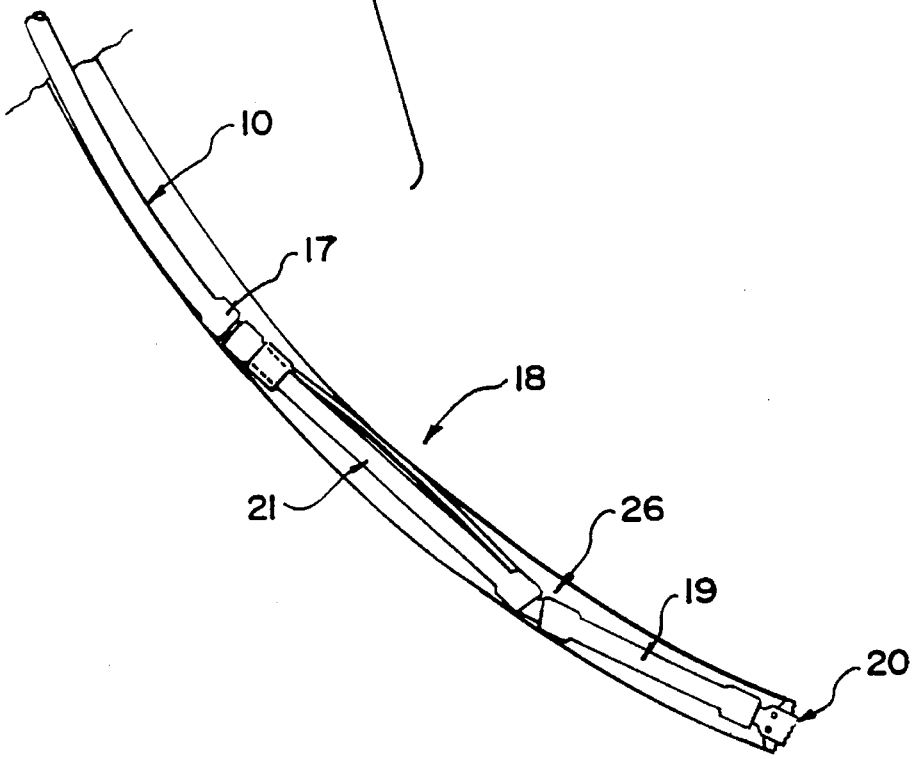

DRILLING A BORE HOLE HAVING A SHORT RADIUS CURVED SECTION FOLLOWED BY A STRAIGHT SECTION

This application is a continuation of application Ser. No. 352,039, filed Nov. 30, 1994, now abandoned, which is a continuation-in-part of application Ser. No. 08/179,560, filed Jan. 20, 1994 and now abandoned.

This invention relates to a method of drilling a bore hole having a short radius curved section followed by a straight section which is usually horizontal, and more particularly to a method of steering the drill bit while drilling the straight section. The bore hole can be of a type used for various purposes including oil and gas exploration and also including the installation of underground utility lines. The short radius curved section can be the first such section provided at the lower end of a vertical section or it can be one of a plurality of such curved sections used for steering a bore hole in a complex shape around various obstacles.

BACKGROUND OF THE INVENTION

It is previously known that a substantially vertical well bore can be turned with a short radius curved section into an inclined or horizontal well bore by providing a drilling tool which includes a bend section defining a transverse bend axis between a forward drill bit support portion and a trailing motor portion. The bend section of the drilling tool tends to steer the well bore so that it turns to a direction at right angles to a plane containing the bend axis. One particular example of this technique is disclosed in my U.S. Pat. No. 5,265,687. In this patent I also proposed that the bore be continued in a horizontal direction after the curved section is complete by adding shims to the underside of the drilling tool.

It is also known to steer a drilling tool during the drilling of a horizontal section by providing a drilling tool which has a slight angle, known as a fixed bent sub. This tool is then fed into the horizontal section and the whole tool rotated in the bore as the bit rotates. The speed of rotation of the tool, driven by the drill string, is slow relative to the rotation of the drill bit and can be of the order of 20 rpm relative to 200 rpm for the drill bit. This slow rotation of the drill string and bent sub has been found to keep the drilling direction more accurate than simply trying to guide a straight sub with shims or the like.

However, it is not possible to rotate the structure shown in my patent including the knuckle portion and the shims since this would put too much stress on the tool and lead to rapid mechanical break-down. Simply using a thinner shim and rotating the tool allows the tool too much movement and undue stress in the hole.

A number of different previous patents have shown shims or similar projections mounted on the side surface of the drilling tool to assist in guiding the drilling tool while the drill bit rotates. Examples of these are U.S. Pat. Nos. 4,492,276 (Kamp), 4,220,213 (Hamilton), 4,465,147 (Feenstra) and 4,442,908 (Steenbock). However as stated above, these shims or projections cannot allow the tool to rotate in the well bore at the slow rate of rotation to utilize the above technique for steering the drill bit.

U.S. Pat. No. 5,090,496 (Walker) discloses a fixed bent sub of the type mentioned above in which the tool housing is thickened on one side of the housing at the bend so as to attempt to increase the deviation of the drill bit from the straight line to provide a shorter radius of the curved section.

The thickened portion of the housing is however entirely fixed to the housing and can not be removed. This prevents the tool from being used in the technique of my previous patent in which it is essential to have a bend section which allows bending of the tool from an initial coaxial position to a second position in which the knuckle joint between the two sections is offset to one side of the axis.

Various arrangements of eccentric collar are disclosed in U.S. Pat. Nos. 4,699,224 and 4,739,843 of Burton. Both of these patents disclose a drill string with a number of flexible or bend sections arranged in a row from the drill bit through to a straight section of the drill string arranged in the straight section of the bore hole. The eccentric collar is arranged at the bend section between the drill bit support portion and the next adjacent portion of the drill string. The collar includes a plurality of radially projecting elements or fins which lock the collar against the wall of the bore and thus prevent the collar from rotating. The drill string thus rotates within the collar and drives the drill bit. There is no possibility of the eccentric collar being locked to the drill string since the collar is intended for use during the drilling of the curved section and hence, if locked to the drill string would prevent the curvature from forming.

SUMMARY OF THE INVENTION

It is one object of the present invention, therefore, to provide an improved drilling method and apparatus which allows use of the tool and method shown in the above patent to drill a short radius curved section and subsequently by addition of a guide collar to drill an accurately horizontal or straight section after the curved section is complete.

According to one aspect of the invention there is provided a method of drilling a bore hole in the earth including a short radius curved section and a substantially straight section at an end of the curved section comprising: providing a drill string and connecting a supply of drilling fluid to a trailing end of the drill string for pumping the drilling fluid therethrough; providing a drilling tool having an elongate tool body with a first tool portion and a second tool portion, providing in the drilling tool a motor mounted on one of the tool portions of the tool body to generate drive power, providing on the drilling tool a drill bit mounted on the first tool portion at a leading end thereof for rotation relative to the tool body in response to the drive power from the motor; providing in the drilling tool knuckle means defining a bend section in the tool body between the first and second tool portions defining a bend axis transverse to the longitudinal axis of the tool body about which the first tool portion carrying the drill bit will bend relative to the second tool portion to vary an orientation of a longitudinal axis of the first portion from a first orientation coaxial with a longitudinal axis of the second portion to a second orientation in which the longitudinal axis of the first portion lies at an angle relative thereto with the knuckle means bent to one side of the axis; providing an eccentric collar for closely surrounding the tool body at a position thereon adjacent the knuckle means at the bend section; shaping the eccentric collar to provide an inner surface of the eccentric collar contacting the tool body and an outer surface of the eccentric collar which is eccentric relative to the longitudinal axis of the tool body so as to have a thicker portion of the eccentric collar on one side of the tool body and a thinner portion on an opposite side of the tool body such that the thicker portion has an outer surface with a greater radial distance from the longitudinal axis than that of the thinner portion; with the eccentric collar removed, drilling the curved section by causing the portions to move to the second orientation and rotating the drill bit while the drill string is maintained halted against rotation about the longitudinal axis; at the end of the curved section, attaching onto the tool body the eccentric collar at the position thereon adjacent the knuckle means and fixing the eccentric collar relative to the tool body for co-rotation therewith in the bore hole, the bend axis being arranged substantially at right angles to a line joining the thicker portion to the opposed thinner portion, the thicker portion being located on a side of the axis opposite to said one side; and engaging the eccentric collar and the drill bit with the bore hole, rotating the drill bit on the drilling tool and rotating the tool body and the eccentric collar about the longitudinal axis within the drill bore at a rate of rotation less than that of the drill bit so as to guide substantially straight forward movement of the tool body along the straight section of the bore hole.

According to a second aspect of the invention there is provided a drilling tool for drilling a bore hole in the earth including a short radius curved section and a substantially straight section at an end of the curved section comprising: an elongate tool body with a first tool portion and a second tool portion, a motor mounted on one of the tool portions of the tool body to generate drive power, a drill bit mounted on the first tool portion at a leading end thereof for rotation relative to the tool body in response to the drive power from the motor; knuckle means defining a bend section in the tool body between the first and second tool portions defining a bend axis transverse to the longitudinal axis of the tool body about which the first tool portion carrying the drill bit bends relative to the second tool portion to vary an orientation of a longitudinal axis of the first portion from a first orientation coaxial with a longitudinal axis of the second portion to a second orientation in which the longitudinal axis of the first portion lies at an angle relative thereto with the knuckle means bent to one side of the axis; an eccentric collar, means for mounting the eccentric collar closely surrounding the tool body at a position thereon adjacent the knuckle means, said mounting means being arranged such that the eccentric collar is removable from and readily replaceable on the tool body, the eccentric collar having an inner surface for contacting the tool body and an outer surface which is eccentric relative to the longitudinal axis of the tool body so as to have a thicker portion of the eccentric collar on one side of the tool body and a thinner portion on an opposite side of the tool body such that the thicker portion has an outer surface with a greater radial distance from the longitudinal axis than that of the thinner portion; said mounting means including fixing means for holding the eccentric collar fixed on the tool body against rotational movement relative thereto during rotation of the tool body in the bore hole.

One embodiment of the invention will now be described in conjunction with the accompanying drawings in which:

BRIEF DESCRIPTION OF THE DRAWINGS

FIG. 1 is a schematic side elevational view of a drilling system according to the present invention drilling a short radius curved section of the bore hole, the arrangement being substantially as shown in my prior U.S. Pat. No. 5,265,687 identified above.

In the drawings like characters of reference indicate corresponding parts in the different figures.

DETAILED DESCRIPTION

Figure 2:
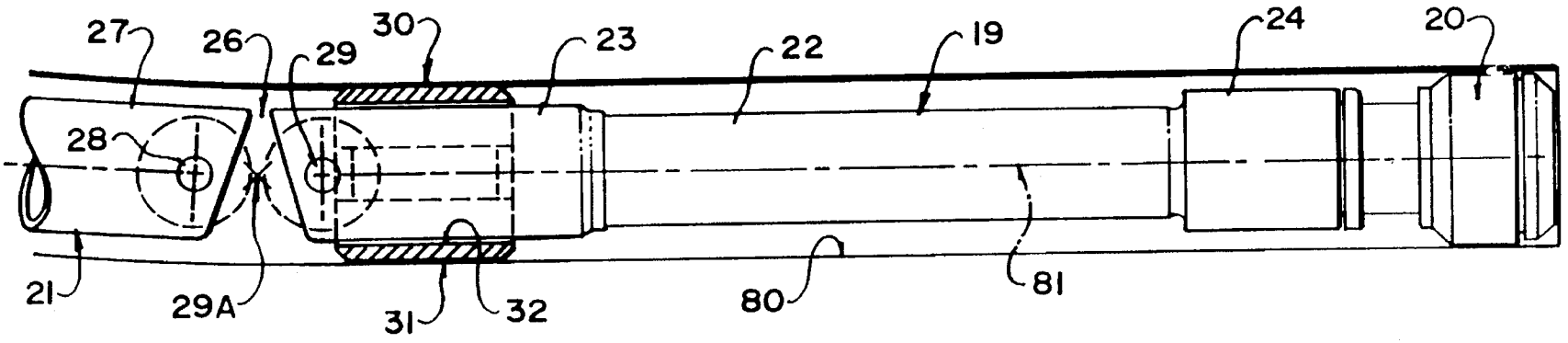
FIG. 2 is a schematic side elevational view of the drilling tool showing a first concentric collar attached thereto for drilling a first horizontal portion of the bore hole.

The arrangement of the present invention is based on my above U.S. patent, the disclosure of which is incorporated herein by reference. In particular the down hole drilling tool as shown in FIG. 1 is taken from the disclosure of the above patent. In addition FIG. 1 also shows the above ground construction which is shown schematically for completeness.

The apparatus therefore includes a drill tubing which as shown can comprise coiled tubing 10 supplied from a reel (not shown) over a guide arch 11. From the arch 11, the tubing enters an injector schematically indicated at 12 which is again of a conventional nature and acts to grasp the tubing using blocks which frictionally engage the tubing and force the tubing longitudinally both in the downward or the upward direction for feeding and withdrawing the tubing into the well bore. The construction of the injector is well known and this also acts to hold the tubing against rotation in a twisting direction so that the tubing is fed directly longitudinal without any twisting about its axis. In one known arrangement of the injector the tubing is grasped by opposed blocks, each of which has a front face of semi-cylindrical shape so that together the blocks form the majority of a cylinder surrounding the tubing. A plurality of the blocks are then mounted in two rows carried on a pair of opposed chains and movable thereby longitudinally of the well bore. The blocks are biased into engagement with the tubing by guide plates.

From the injector, the tubing passes into the well bore through a stripper 13, a blow out protector (BOP) 14 and a lubricator 15 to the well head 16. The stripper, BOP and lubricator are of a well known and conventional nature and are therefore shown only schematically and will not be described in detail herein.

My U.S. Pat. No. 5,265,687 describes the technique for drilling the short radius curved section. In particular the drilling system includes the drill tubing 10 having a coupling 17 at the lower end for attachment to the drilling tool 18. The tool 18 includes a first portion 19 carrying the drill bit 20 and a second portion 21 housing the motor. A knuckle or bend section 26 is located between the two portions. The method by which the tool drills the short radius curved section is fully described in my above patent and therefore will not be repeated here.

The arrangement shown in FIGS. 2, 3, 4 and 5 shows the apparatus and technique for drilling a horizontal portion subsequent to the short radius curved section. Reference is therefore made to the above U.S. patent for full disclosure of the construction of the drilling tool itself and disclosure of that patent is incorporated herein by reference.

In general terms the drilling tool comprises the drilling bit 20 mounted on a drill bit support section 19 which contains bearings for supporting an elongate shaft of the drilling bit. The drill bit support section includes a central sleeve portion 22 which is connected at each end to a coupling section 23, 24 of larger diameter. Each of these sections is of constant circular cross section. The center section 22 is fastened to the end section 23 and 24 at couplings schematically indicated at 25. Generally the sections are fastened together by screw thread coupling which allows one section to be unscrewed from the next.

At the end 23 of the drill bit support section 19 is provided the knuckle portion generally indicated at 26 which connects to a main drive portion 27 of the drilling tool as described in the above patent. The knuckle portion generally includes two knuckle pins 28 and 29 which allow pivotal movement of the drill bit support section 19 relative to the main drive section 27 about a transverse axis indicated at 29A.

Figure 3:
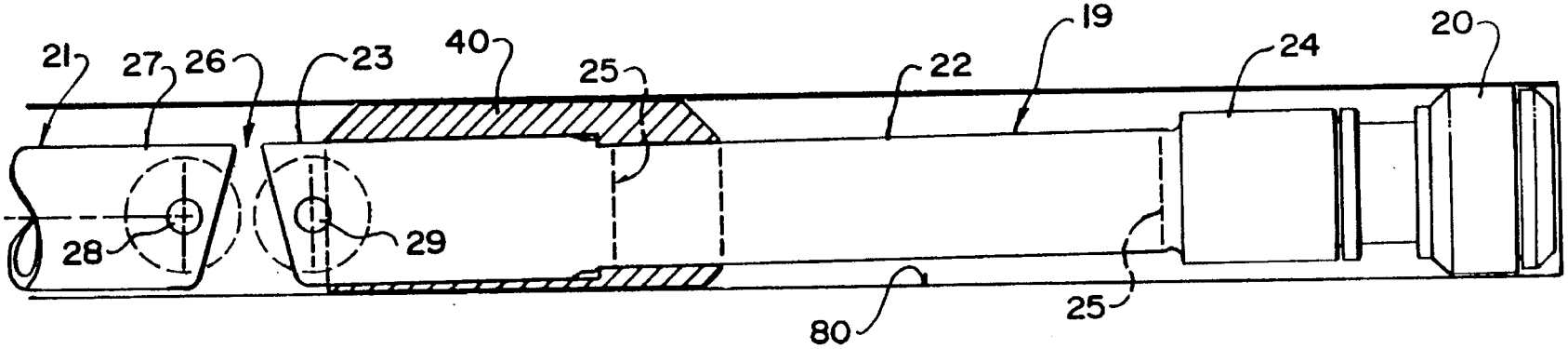
FIG. 3 is a schematic side elevational view of the drilling tool showing a second eccentric collar attached thereto for drilling a second horizontal portion of the bore hole.
Figure 4:
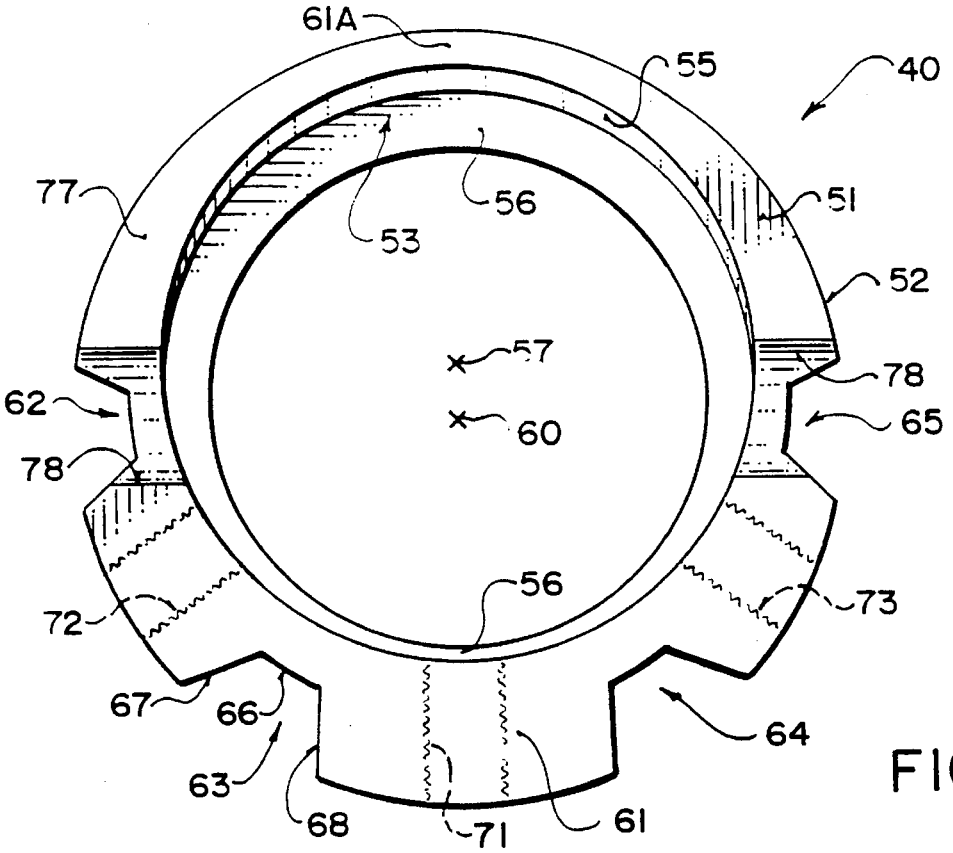
FIG. 4 is an end elevational view of the second collar of FIG. 3.

The drilling tool of the above patent as described above is modified by the addition thereto of a first collar 30 shown in FIG. 2 and subsequently of a second collar 40 shown in FIGS. 3, 4 and 5.

The second collar 40 basically comprises a sleeve including a sleeve body 51 defining an outer surface sleeve surface 52 and an inner sleeve surface 53.

The inner sleeve surface 53 includes a first bore portion 54 and a second bore portion 55 of increased diameter connected at a step or shoulder 56 lying in a radial plane of the sleeve. The difference in diameter in the bore portion 54 and the bore portion 55 is arranged to accommodate the differences in diameter between the portion 22 and the portions 23 of the drill bit support section. Thus the bore portion 54 has a diameter to closely match the outside diameter of the portion 22 as a sliding fit. The bore portion 55 similarly has a diameter to match the diameter of the portion 23 as a sliding fit, The shoulder 56 is located at a position so that the intersection between the two portions is located adjacent the shoulder.

The bore portions 55 and 54 are arranged to coaxially surround an axis 57 which is shown in dash line.

The outer surface 52 is generally cylindrical of a substantially constant outside diameter from a first end 58 through to a second end 59. However the outer surface 52 surrounds an axis 60 which is offset to one side of the axis 57 so that the outer surface is eccentric relative to the axis 57 and relative to the inside surface. Thus as best shown in FIG. 4, the collar includes a thicker wall portion 61 on one side of the longitudinal axis of the drilling tool relative to a second portion 61A on the opposed side or at a 180° spacing.

Figure 5:
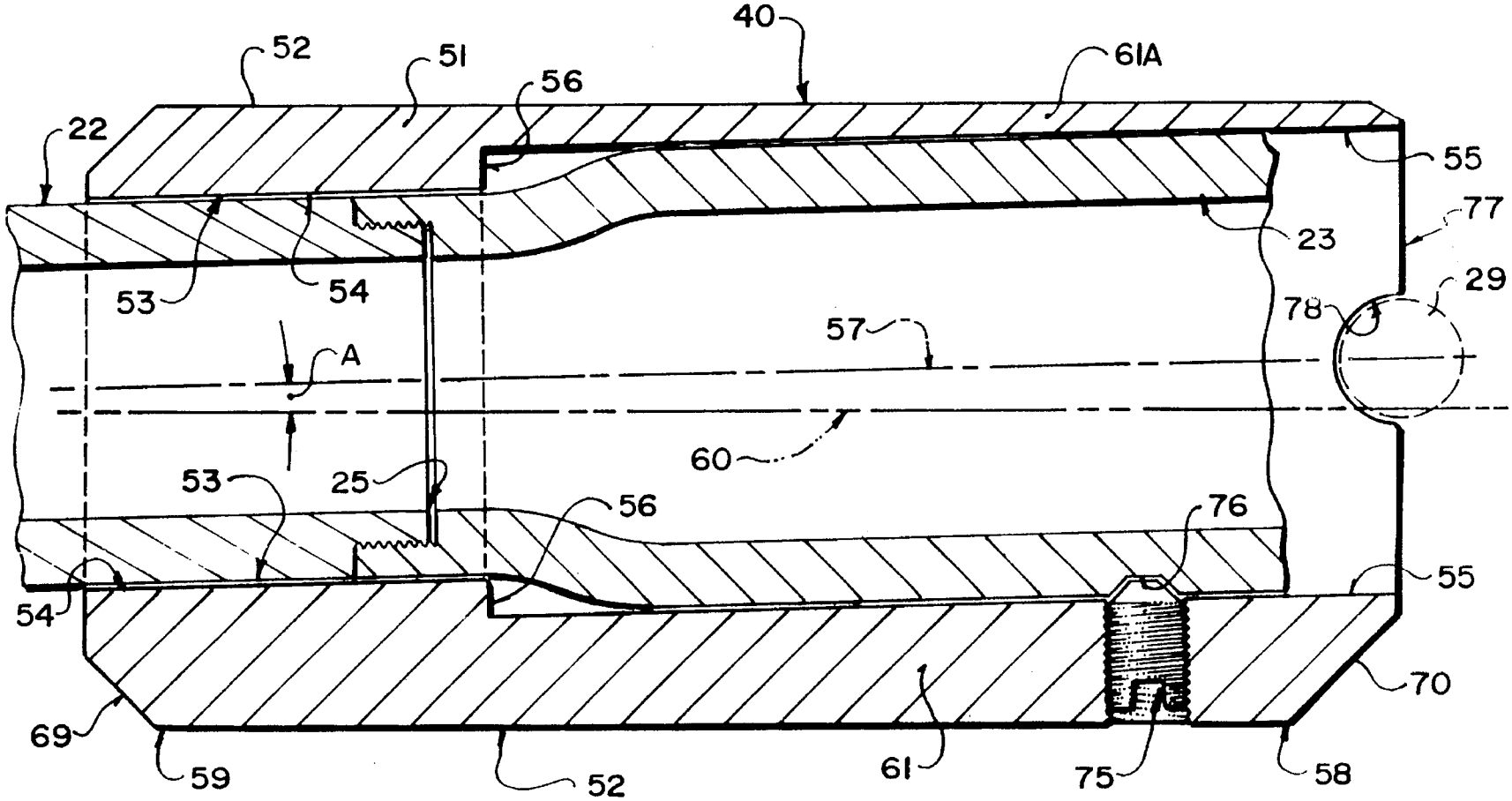
FIG. 5 is a longitudinal cross-sectional view of the second collar of FIG. 3.

In the thicker section 51 which in FIG. 5 is arranged at the 6:00 o'clock position there are provided four grooves 62, 63, 64 and 65 arranged at the 9:00 o'clock, 7:00 o'clock, 5:00 o'clock and 3:00 o'clock positions respectively. These grooves are received in the thicker part of the eccentric collar so they do not reach through to the inner surface 53. The grooves are arranged along the full length of the outer surface 52 and are parallel to each other and to the axis 60. The grooves each have a flat base 66 and side walls 67, 68 which converge toward the flat base from a wider open mouth at the surface 52. The grooves act to allow the passage of drilling fluid between the collar and the inside surface of the well bore. At the ends 58 and 59, the outer surface is chamfered as indicated at 69, 70 to assist in allowing the collar to slide longitudinally without providing sharp edges at the ends for engaging the well bore and interfering with sliding movement.

In addition to the eccentric offset of the axis 60 from the axis 57, the axis 60 is also arranged at a shallow angle A relative to the axis 57. This angle A is preferably of the order of 1.2 degrees. In FIG. 4 a part of the inside surface 55 is visible at the top part of the drawing since the view is taken looking along the axis 60. In addition the thickness of the shoulder 56 appears because of the viewing axis 60 to decrease decreases from the top part of the 12:00 o'clock position to the lower part of the 6:00 o'clock position.

In order to fasten the collar to the drill bit support portion of the drilling tool, the portion 19 is separated at one of the connections 25 allowing the collar to slide onto the portion 22 longitudinally of the portion 22 until the shoulder 56 begins to engage the wider part at the portion 23.

In order to hold the collar fixed in place, the collar includes three threaded bores 71, 72 and 73 arranged through the thickest part of the collar between the channels 62, 63, 64 and 65. Thus the threaded bores are arranged at the 4:00 o'clock, 6:00 o'clock and 8:00 o'clock positions as shown in FIG. 4. Each of the threaded bores can receive a set screw 75 which engages into a recess 76 drilled into the outer surface of the portion 23 at the required location to properly locate the collar. The set screw has a tapered upper end for engaging into a similarly shaped recess thus acting to slightly twist and slide the collar in the manner of a pilot screw if the holes are not properly aligned with the recesses.

In order to accommodate the transverse pin 29 of the knuckle, the end face 77 of the collar includes a pair of semi-circular recesses 78 arranged at the 3:00 o'clock and 9:00 o'clock positions along which the axis 20 of the knuckle portion lies.

The collar 30 is of a similar construction to that of the collar of 40 except that it has an outer surface 31 lying coaxial with its inner surface 32. Thus there is no eccentric offset and in addition there is no angular offset so that the axis of both the inner and outer surfaces of the collar lie directly along or coincidental with the axis of the portion 23. The collar 30 includes set screws located in the collar in position similar to the set screw 75. The collar 30 includes longitudinal recesses or channels similar to the recesses 62 through 65 of the collar 40.

In operation, after the curved section of the well bore is drilled up to the required horizontal orientation, the drill string is withdrawn from the well bore by operation of the reel and tubing as described herein before. Measuring equipment can then be inserted into place to check the accuracy of the bore. Any adjustments necessary are then effected by carrying out further drilling as required. However when the proper orientation of the bore is achieved, with the drill string removed, the collar 30 is attached in place onto the portion 23 and the drill string and drilling tool returned into the drilling position at the lower end of the well bore.

The outside diameter of the collar 30 is arranged relative to the drill bit 20 so that the collar 30 engages the inside surface of the well bore indicated at 80 and acts to hold the portion 19 of the drilling tool along a central axis 81 of the well bore so as to provide drilling in the horizontal direction. This drilling is continued for a distance of the order of four meters. It is known however that simply guiding the drilling tool in this manner does not provide long term accuracy in the directional control but over a four meter distance there is very little likelihood of significant deviation from the intended horizontal direction.

When the four meter section is however complete, the drill string is removed as previously described and the collar 30 removed from the tool. The collar 40 is then located in place on the tool and the drill string returned to the downhole location at which the drill bit 20 reaches the end of the bore hole.

In this position, drilling is recommenced but simultaneously with the rotation of the drill bit at a rate of the order of 200 rpm, the whole drill string is simultaneously rotated about the longitudinal axis of the drill string thus rotating the collar and the tool generally about the longitudinal axis of the well bore 80 at the horizontal section. The eccentric shape of the collar biases the knuckle portion 26 toward one side of the well bore. Simultaneously the angle A of the collar causes the portion 22 of the drilling tool to be held at the same angle A to the longitudinal axis of the well bore. Thus in effect the angle between the portion 22 and the portion 21 at the knuckle portion 26 about the axis 29A is held at a substantially fixed shallow angle. This effect in conjunction with the rotation of the drill string and therefore of the axis 29A about the longitudinal axis of the well bore causes automatic steering of the drilling tool. It will be appreciated that as the drill string rotates and the axis 29A rotates about the longitudinal axis of the well bore, the angle of attack of the drill bit rotates about the longitudinal axis of the well bore. This angle of attack is varied in view of the angle A slightly from the longitudinal axis of the well bore and the continuous rotation causes this angle of attack to be continually rotated about the longitudinal axis of the well bore. This continuous rotation of the slight angle acts to overcome any inconsistencies in the materials being drilled and acts to tend to hold the direction of drilling in a more accurately horizontal orientation.

If the tool strays off its path, the tool can be stopped at any angle to slowly correct itself by the steering action of the angle as described above. Once the proper angle is attained, the rotation of the tool is resumed.

Figure 6:
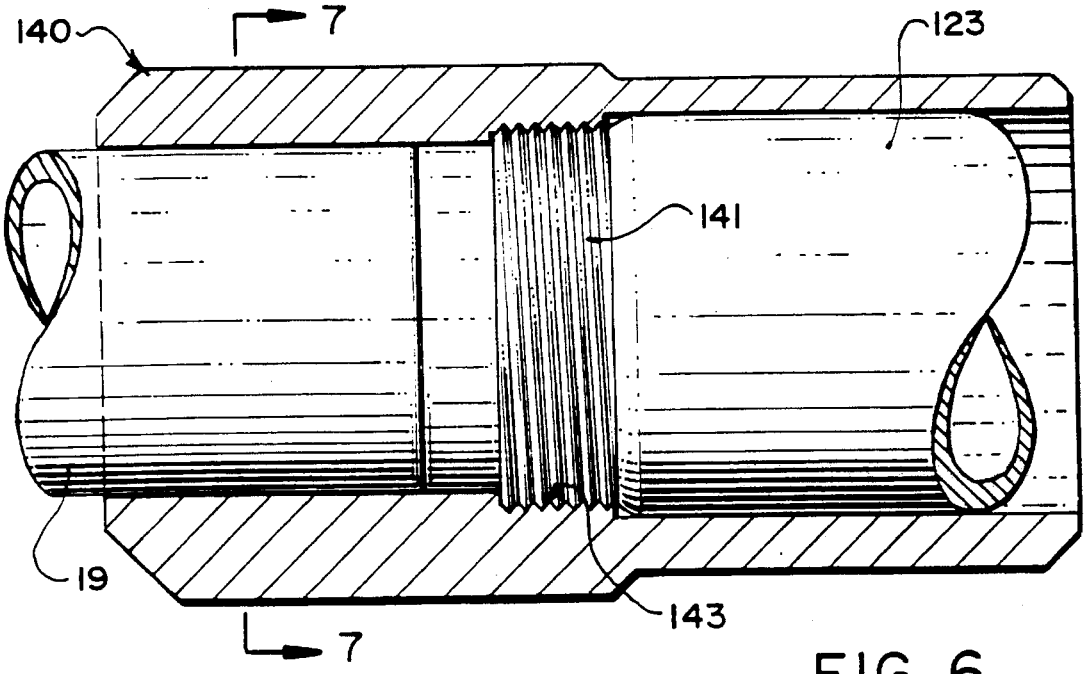
FIG. 6 is a longitudinal cross-sectional view similar to that of FIG. 5 showing a modified embodiment of the eccentric collar.

Turning now to FIG. 6 there is shown a modification of the arrangement shown in FIG. 5 in which the collar 140 is modified relative to the collar 40 in that it is attached to the drill bit support section 123 by a male-threaded section 141 provided on an outer surface of a thickened portion 142 of the drill bit support and a female-threaded section 143 provided on the inside surface of the collar. The collar is therefore attached onto the first portion of the drilling tool by removing the drill bit and sliding the collar as a sliding fit longitudinally along the outer surface of the first portion 19 to a position engaging up against the drill bit support section 123. The direction of the thread is arranged such that the collar remains fixed in place on the tool when the tool is rotated in the technique described above. The collar thus remains fixed in place when the tool rotates and rotates commonly therewith. The collar can of course be removed by grasping by a suitable tool and rotating the collar in the opposite direction to unthread the threaded sections to release the collar for sliding again over the open end of the portion 19 with the drill bit 20 removed.

Figure 7:
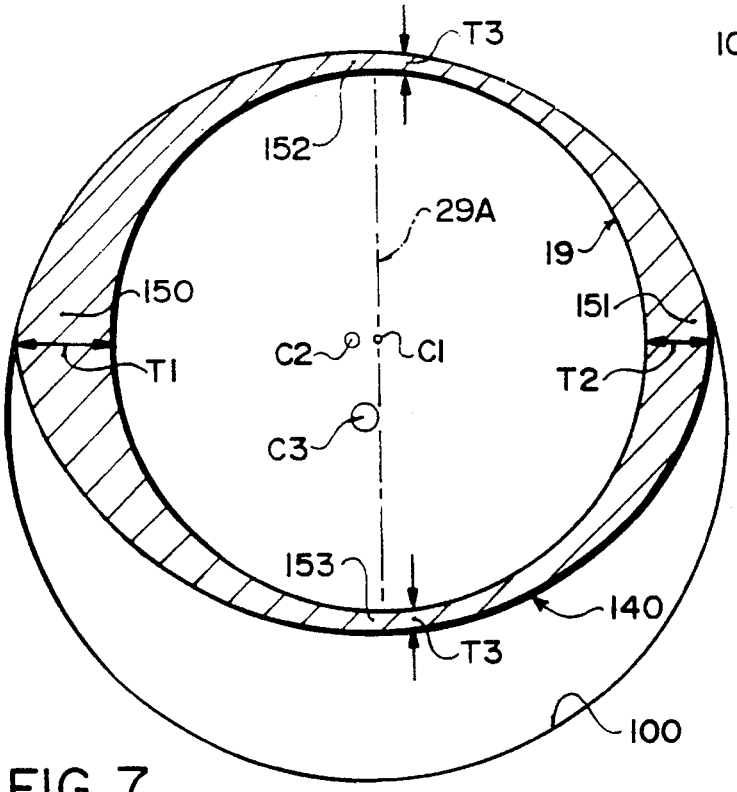
FIG. 7 is a transverse cross-sectional view of the collar of FIG. 6 showing the collar in the bore hole in an orientation allowing rotation of the collar and drill string about the longitudinal axis of the bore.
Figure 8:
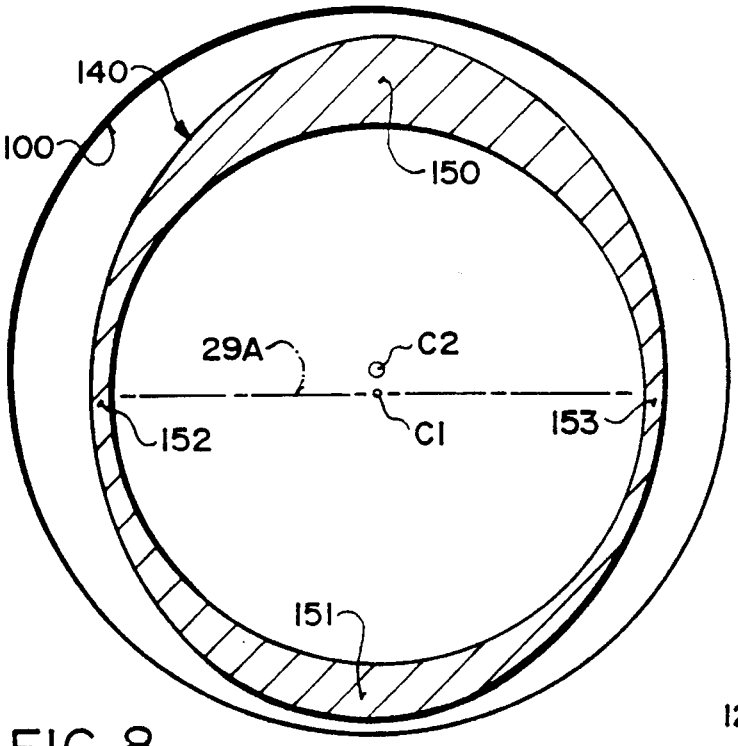
FIG. 8 is a transverse cross-sectional view of the collar of FIG. 6 showing the collar in the bore hole in an orientation for effecting steering of the drill bit to correct a deviation from a required direction.

In addition the collar 140 is modified to include a cross-section as shown in FIGS. 7 and 8. The cross-section of FIG. 7 is taken along the lines 7—7 of FIG. 6. The cross-section is thus modified so that the collar 140 is eccentric so that it has a center C2 which is offset from a center C1 of the tool portion 19. For convenience of illustration the tool portion 19 is only shown in regard to its outer surface which is cylindrical and thus of circular cross-section. As the cross-section of the collar 140 is eccentric, it defines a lobe 150 which is opposed to a second lobe 151. The lobe 150 has a thickness T1 from the surface of the portion 19 which is greater than the thickness T2 of the lobe 151. The collar 140 is however modified relative to the collar 40 in that it has sides 152 and 153 which are flattened, that is they are thinner than the lobe 151 defining a thickness T3 which is less than the thickness T2. As the sides 152 and 153 are flattened, there's no longer any necessity for the channels of the arrangement of collar 40 since there is sufficient space around the outside surface of the sides 152 and 153 to allow the passage of the drilling fluid.

It will be noted that the sides 152 and 153 are diametrically opposed and lie in a plane containing the bend axis 29A. Thus the lobes 150 and 151 are arranged in a plane at 90 degrees to the bend axis 29A similar to the position shown in FIG. 3.

The purpose of the flattened sides is to allow the collar to rotate within a well bore which is slightly curved, having a curvature with a radius longer than the short radius curvature of the curved section first formed. It will be appreciated that the knuckle allows bending only about a single bend axis 29A and in the direction at right angles to the bend axis there is no possibility for the tool to bend and accordingly, without the flattened sides, the tool will bind within a slightly curved bore hole thus preventing rotation through 360 degrees. However it has been found that it is possible to manufacture a collar with sides 152 and 153 sufficiently thin or flattened to allow the tool to rotate within a bore having a curvature formed by the degree of eccentricity defined by the lobes 150 and 151. The center of the bore hole is indicated at C3.

The single collar 140 shown in FIGS. 6, 7 and 8 can therefore be used as a replacement for the two collars 30 and 40.

In operation of the collar 140, therefore, the short radius curved section is drilled with the collar removed and as described in my above patent. With the collar thus removed, the knuckle is free to run against the side of the bore hole and thus biases the drill bit to the maximum deviation angle to provide a short radius curvature.

If it is intended to turn from vertical to horizontal that is a turn through 90 degrees, the drilling of the short radius curvature is terminated at an angle slightly before the 90 degree angle that is at an angle of the order of 86 degrees. The tool is then withdrawn from the hole and the collar 140 is applied as previously described. The tool is then returned to the drilling face and the drill string is rotated to the position shown in FIG. 8 in which the thicker lobe 150 is moved to a position on the inside of the curvature so the lobe 151 is on the outside of the curvature. The lobe 150 thus biases the collar and the adjacent knuckle toward the outside of the curvature thus causing the drill bit to form a bore hole which is gradually curved. In the gradual curvature, the radius of curvature can be of the order of 200 feet. A 200 foot radius bends about one degree for each 3.5 feet drilled so after drilling 14 feet, the bore hole has reached the full 90 degrees from the vertical. The last 14 feet of the bore hole is therefore formed at the 200 foot radius and this 14 feet in length of the bore hole and shallow curvature allows the tool including the collar to be rotated about the longitudinal axis of the tool. The lobes can rotate in view of the fact that they are at right angles to the bend axis and the bend axis accommodates the curvature of the bore hole. The flat sides are able to rotate even though they are not aligned with the bend axis since they are sufficiently thin as shown in FIG. 7 to accommodate the curvature of the bore hole.

After the formation therefore of the last length of the curved section with the increased radius of curvature, the tool can be rotated as described above at a continuous relatively slow rate of rotation less than that of the drill bit to provide the accurate steering technique explained above.

In the event that it is detected that the direction has deviated from the required straight direction, the tool can be halted and rotated to align the lobe 150 with the required direction of curvature to return to the intended straight direction. The drill bit can then be rotated with the tool held stationary to provide a long radius curvature section. As explained above, the rotation of the tool can then be recommenced in view of the fact that all four sides of the tool can rotate in the curved bore hole so formed.

Figure 9:
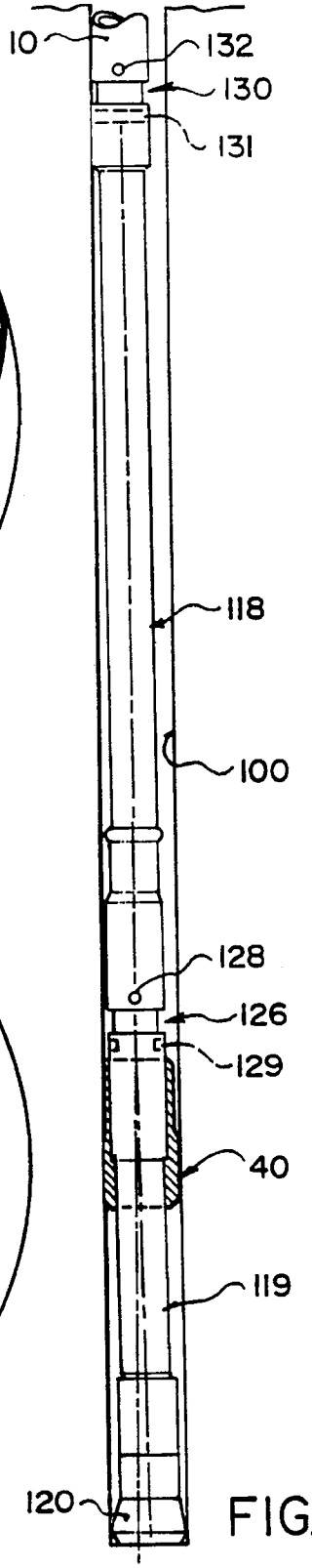
FIG. 9 is a longitudinal cross-sectional view of the drilling tool showing the collar of FIGS. 3, 4 and 5 on a modified arrangement of the tool.

Turning now to FIG. 9, there is shown a further alternative arrangement which utilizes the collar 40 mounted on the drilling tool. The drilling tool is shown within a well bore 100 and includes the drill bit support portion 119 carrying the drill bit 120. The drill bit support portion is connected to the second portion 118 which carries the drive motor. The first portion 119 is connected to the second portion 118 by the knuckle joint 126 with the collar arranged, previously described, closely adjacent the knuckle joint 126.

The above arrangement is however modified relative to the previously described drilling tool in that the knuckle joint includes a first pivot pin 128 similar to the pin 28 and a second pivot pin 129 which is arranged at right angles to the pin 128. The knuckle joint is therefore defined by the two pins but the pins are arranged mutually at right angles so that there is the possibility of pivotal movement about two axes at right angles rather than the single axis 29A of the drilling tool described above. This ability of the knuckle joint to pivot about the two axes at right angles obviates the necessity for the flat sides of the collar 140 and instead allows the use of the collar 40. More particularly the pivot pin 129 allows pivotal movement about a line at right angles to a line joining the sides of the collar so the sides can be of the full diameter equal to the diameter at right angles to the line joining the sides. Thus the collar is of cylindrical outer shape but the center of the collar is offset.

The drilling tool is also modified relative to the tool described above in that there is provided a second pivot coupling at the upper end of the portion 118 connecting the portion 118 to the drill string 10. The pivot coupling is indicated at 130 and again includes two pivot pins 131 and 132 arranged at right angles. This again allows the necessary pivotal movement for the tool to accommodate the curvature of the bore as it rotates about its axis.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A method of drilling a bore hole in the earth including a short radius curved section and a substantially straight section at an end of the curved section comprising:

providing a drill string and connecting a supply of drilling fluid to a trailing end of the drill string for pumping the drilling fluid therethrough;

providing a drilling tool having an elongate tool body with a first tool portion and a second tool portion, providing in the drilling tool a motor mounted on one of the tool portions of the tool body to generate drive power, providing on the drilling tool a drill bit mounted on the first tool portion at a leading end thereof for rotation relative to the tool body in response to the drive power from the motor;

providing in the drilling tool knuckle means defining a bend section in the tool body between the first and second tool portions defining a bend axis transverse to the longitudinal axis of the tool body about which the first tool portion carrying the drill bit will bend relative to the second tool portion to vary an orientation of a longitudinal axis of the first portion from a first orientation coaxial with a longitudinal axis of the second portion to a second orientation in which the longitudinal axis of the first portion lies at an angle relative thereto with the knuckle means bent to one side of the axis;

providing an eccentric collar for closely surrounding the tool body at a position thereon adjacent the knuckle means at the bend section;

shaping the eccentric collar to provide an inner surface of the eccentric collar contacting the tool body and an outer surface of the eccentric collar which is eccentric relative to the longitudinal axis of the tool body so as to have a thicker portion of the .eccentric collar on one side of the tool body and a thinner portion on an opposite side of the tool body such that the thicker portion has an outer surface with a greater radial distance from the longitudinal axis than that of the thinner portion;

with the eccentric collar removed, drilling the curved section by causing the portions to move to the second orientation and rotating the drill bit while the drill string is maintained halted against rotation about the longitudinal axis;

at the end of the curved section, attaching onto the tool body the eccentric collar at the position thereon adjacent the knuckle means and fixing the eccentric collar relative to the tool body for co-rotation therewith in the bore hole, the bend axis being arranged substantially at right angles to a line joining the thicker portion to the opposed thinner portion, the thicker portion being located on a side of the axis opposite to said one side; and engaging the eccentric collar and the drill bit with the bore hole, rotating the drill bit on the drilling tool and rotating the tool body and the eccentric collar about the longitudinal axis within the drill bore at a rate of rotation less than that of the drill bit so as to guide substantially straight forward movement of the tool body along the straight section of the bore hole.

2. The method according to claim 1 including providing on the eccentric collar an end face having a pair of recesses for receiving elements of the bend section.

3. The method according to claim 1 including providing on an outside surface of the eccentric collar a plurality of longitudinally extending grooves therealong allowing transmission between the eccentric collar and the bore hole of drilling fluid.

4. The method according to claim 1 including sliding the eccentric collar longitudinally of the tool body for attachment thereto and removal therefrom.

5. The method according to claim 1 including shaping the eccentric collar so that the thicker and thinner portions lie on a first imaginary cylinder surrounding the axis and so that the eccentric collar includes an inner surface lying on a second imaginary cylinder within the first imaginary cylinder, the second cylinder having a longitudinal axis at a shallow angle relative to the longitudinal axis of the first cylinder.

6. The method according to claim 1 including halting the rotation of the drill string at a selected angle about the longitudinal axis while continuing to rotate the drill bit in order to steer the tool to correct an inaccuracy in the drilling direction and, after the inaccuracy is corrected, restarting the rotation of the drill string.

7. The method according to claim I including providing a male threaded section on the first portion of the tool body adjacent the knuckle means and a matching female threaded section on the eccentric collar and, after removing the drill bit, including sliding the eccentric collar along the tool body and engaging the threaded sections together to hold the collar in fixed position on the tool body.

8. The method according to claim I including providing on the eccentric collar two opposed sides each arranged angularly between said one side and said opposite side and each having an outer surface the radial distance of which from the longitudinal axis is less than that of the thinner portion.

9. The method according to claim 8 wherein the knuckle means is defined by a pair of parallel pivot pins.

10. The method according to claim 1 wherein the knuckle means is defined by a first pivot means parallel to the bend axis and wherein there is provided second pivot means between the first and second portions of the tool body which second pivot means allows bending movement of the toll body at the knuckle means about an axis at a right angle to the bend axis.

11. The method according to claim 10 wherein the collar is shaped so that the outer surface is of circular cylindrical shape.

12. The method according to claim 1 wherein the collar is attached to the tool body at a position along the bore hole just before an intended end of curvature of the bore hole and wherein the rotation of the drill string is maintained halted at a selected angle about the longitudinal axis while continuing to rotate the drill bit such that a short curved section is formed at the end of the curved section, the short curved section having a longer radius of curvature than the curved section.

13. The method according to claim 1 including;

providing a concentric collar having an outside surface of the concentric collar which substantially coaxially surrounds the longitudinal axis of the tool body;

at the end of the curved section and prior to attachment of the eccentric collar, operating the drilling tool with the concentric collar attached thereto to rotate the drill bit to drill a first substantially straight bore section;

removing the concentric collar from the drilling tool, attaching the eccentric collar to the tool body and operating the drilling tool to drill a second substantially straight bore section from the first substantially straight bore section.

14. The method according to claim 1 including providing a second knuckle means between the second portion of the drilling tool and the drill string.

15. A drilling tool for drilling a bore hole in the earth including a short radius curved section and a substantially straight section at an end of the curved section comprising:

an elongate tool body with a first tool portion and a second tool portion, a motor mounted on one of the tool portions of the tool body to generate drive power, a drill bit mounted on the first tool portion at a leading end thereof for rotation relative to the tool body in response to the drive power from the motor;

knuckle means defining a bend section in the tool body between the first and second tool portions defining a bend axis transverse to the longitudinal axis of the tool body about which the first tool portion carrying the drill bit bends relative to the second tool portion to vary an orientation of a longitudinal axis of the first portion from a first orientation coaxial with a longitudinal axis of the second portion to a second orientation in which the longitudinal axis of the first portion lies at an angle relative thereto with the knuckle means bent to one side of the axis;

an eccentric collar, means for mounting the eccentric collar closely surrounding the tool body at a position thereon adjacent the knuckle means, said mounting means being arranged such that the eccentric collar is removable from and readily replaceable on the tool body;

the eccentric collar having an inner surface for contacting the tool body and an outer surface which is eccentric relative to the longitudinal axis of the tool body so as to have a thicker portion of the eccentric collar on one side of the tool body and a thinner portion on an opposite side of the tool body such that the thicker portion has an outer surface with a greater radial distance from the longitudinal axis than that of the thinner portion;

said mounting means including fixing means for holding the eccentric collar fixed on the tool body against rotational movement relative thereto during rotation of the tool body in the bore hole.

16. The drilling tool according to claim 15 wherein the eccentric collar includes an end face having a pair of recesses for receiving elements of the bend section.

17. The drilling tool according to claim 15 wherein the outside surface of the eccentric collar includes a plurality of longitudinally extending grooves therealong allowing transmission between the eccentric collar and the bore hole of drilling fluid.

18. The drilling tool according to claim 15 wherein the eccentric collar and the tool body are shaped such that the eccentric collar can slide longitudinally of the tool body for attachment thereto and removal therefrom.

19. The drilling tool according to claim 18 wherein the eccentric collar is shaped so that the thicker and thinner portions lie on a first imaginary cylinder surrounding the axis and so that the eccentric collar includes an inner surface lying on a second imaginary cylinder within the first imaginary cylinder, the second cylinder having a longitudinal axis at a shallow angle relative to the longitudinal axis of the first cylinder.

20. The drilling tool according to claim 15 wherein the mounting means comprises a male threaded section on the first portion of the tool body adjacent the knuckle means and a matching female threaded section on the eccentric collar.

21. The drilling tool according to claim 15 wherein the eccentric collar includes two opposed sides each arranged angularly between said one side and said opposite side and each having an outer surface the radial distance of which from the longitudinal axis is less than that of the thinner portion.

22. The drilling tool according to claim 15 wherein the knuckle means is defined by a pair of parallel pivot pins.

23. The drilling tool according to claim 15 wherein the knuckle means is defined by a first pivot means parallel to the bend axis and wherein there is provided second pivot means between the first and second portions of the toll body which second pivot means allows bending movement of the tool body at the knuckle means about an axis at a right angle to the bend axis.

24. The drilling tool according to claim 23 wherein the collar is shaped so that the outer surface is of circular cylindrical shape.

25. The drilling tool according to claim 15 including a concentric collar having an outside surface of the concentric collar which substantially coaxially surrounds the longitudinal axis of the tool body, said mounting means being arranged for mounting the concentric collar closely surrounding the tool body at a position thereon adjacent the knuckle means in replacement for the eccentric collar.

26. The apparatus according to claim 15 including a second knuckle means between the second portion of the drilling tool and the drill string.

* * * * *